US011198823B2

(12) United States Patent
Joshi et al.

(10) Patent No.: US 11,198,823 B2
(45) Date of Patent: Dec. 14, 2021

(54) ADVANCED PROCESS FLUID COOLING SYSTEMS AND RELATED METHODS

(71) Applicant: Baker Hughes, a GE company, LLC, Houston, TX (US)

(72) Inventors: Mahendra Joshi, Katy, TX (US); Pejman Kazempoor, Edmond, OK (US); Patrice Rich, Oklahoma City, OK (US)

(73) Assignee: Baker Hughes Holdings LLC, Houston, TX (US)

( * ) Notice: Subject to any disclaimer, the term of this patent is extended or adjusted under 35 U.S.C. 154(b) by 210 days.

(21) Appl. No.: 16/520,749

(22) Filed: Jul. 24, 2019

(65) Prior Publication Data

US 2021/0024834 A1 Jan. 28, 2021

(51) Int. Cl.
*C10G 31/06* (2006.01)
*F28C 3/06* (2006.01)

(52) U.S. Cl.
CPC ..... *C10G 31/06* (2013.01); *F28C 3/06* (2013.01)

(58) Field of Classification Search
USPC ..... 261/62, 118; 137/2; 239/8, 128
See application file for complete search history.

(56) References Cited

U.S. PATENT DOCUMENTS 2,953,306 A * 9/1960 Dijkstra ..... B01F 3/0446 239/417.3
4,915,712 A * 4/1990 Feldsted ..... F28C 3/08 261/116
6,142,457 A * 11/2000 Holtan ..... B01J 8/1818 261/78.2
7,560,022 B2 * 7/2009 Alkhalidi ..... C10G 21/00 210/175
9,920,266 B2 * 3/2018 Khan ..... C10G 11/18
10,478,840 B2 * 11/2019 Khan ..... B01F 3/0446
2001/0043888 A1 * 11/2001 Ito ..... F23D 11/106 422/140
2008/0169576 A1 * 7/2008 Kojima ..... B01D 47/14 261/116
2011/0175244 A1 * 7/2011 Jacobs ..... B01J 4/002 261/118
2015/0013769 A1 * 1/2015 Saunders ..... B05B 7/0491 137/1
2016/0216051 A1 * 7/2016 Kurukchi ..... B01D 3/32

FOREIGN PATENT DOCUMENTS

GB 2129705 A * 5/1984 ..... B01F 3/04

* cited by examiner

*Primary Examiner* — Nina Bhat
(74) *Attorney, Agent, or Firm* — Mossman Kumar & Tyler PC

(57) ABSTRACT

A method of treating/cooling a process fluid includes spraying a working fluid into a stream of the process fluid to form a mixed fluid and separating the working fluid from the mixed fluid to form a treated/cooled process fluid and a separated working fluid. The separated working fluid is conditioned to form a recycled working fluid and sprayed into the stream of the process fluid. A variant includes indirectly cooling a process fluid using a cooled working fluid. The spraying may use a working fluid in the form of microdroplets with Sauter Mean Diameter no greater than 100 microns onto a selected fluid.

11 Claims, 5 Drawing Sheets

ADVANCED PROCESS FLUID COOLING SYSTEMS AND RELATED METHODS

BACKGROUND

Field of the Disclosure

The present disclosure relates to systems and methods for efficiently treating and/or cooling one or more process fluids using one or more working fluids.

Background of the Art

Many industrial processes require that a process fluid be treated and/or cooled at some point using one or more working fluids. For example, a stream of the process fluid may be contacted with the working fluid. During such contact, unwanted contaminants may be removed from the process fluid, the process fluid may be chemically altered or otherwise transformed, thermal energy may be removed from the process fluid, etc. Thereafter, the process fluid is disposed of in some manner.

It would thus be desirable in the art to develop more effective ways to use working fluids to treat and/or cool process fluids.

SUMMARY

In aspects, the present disclosure provides a method of treating/cooling a process fluid. The method may include the steps of: spraying a working fluid into a stream of the process fluid to form a mixed fluid; separating the working fluid from the mixed fluid to form a treated/cooled process fluid and a separated working fluid; conditioning the separated working fluid to form a recycled working fluid; and spraying the recycled working fluid into the stream of the process fluid.

In further aspects, the present disclosure provides a method of treating/cooling a process fluid that includes the steps of spraying a working fluid into a cooling fluid to form a mixed fluid; separating the working fluid from the mixed fluid to form a cooled working fluid and a separated cooling fluid; indirectly cooling a process fluid using the cooled working fluid; and recycling the cooled working fluid after the indirect cooling by spraying the cooled working fluid into the cooling fluid.

In still further aspects, the present disclosure provides a method of treating/cooling a process fluid that includes the steps of spraying at least one working fluid in the form of microdroplets with Sauter Mean Diameter no greater than 100 micrometers onto a selected fluid; separating the at least one working fluid from the selected fluid using centrifugal separation; and contacting the process fluid with the microdroplets of at least one working fluid.

DETAILED DESCRIPTION

In aspects, the present disclosure provides systems and related methods for treating/cooling a process fluid using a recycled working fluid. For simplicity, terms such as "treat(ing)/cool(ing)" mean "treat(ing) and/or cool(ing)", i.e., collectively and alternatively. By treating, it is meant that one or more components of the process fluid are transformed, converted, or otherwise altered by a mechanism such as chemical interaction, mechanical interaction, [etc]. By cooling, it is meant that thermal energy has been removed from the process fluid.

Figure 1:
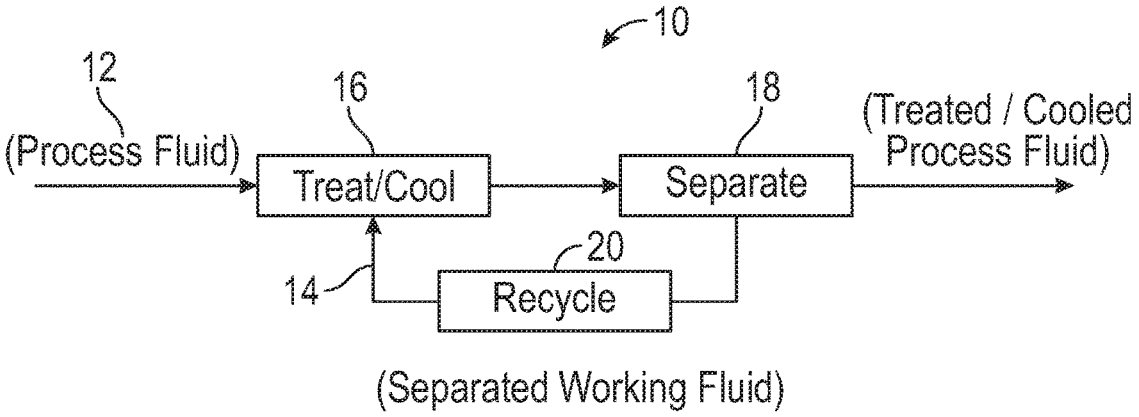
FIG. 1 is a flow chart illustrating one embodiment of a method for treating and/or cooling a process fluid according to the present disclosure.

Referring to FIG. 1, there is shown an illustrative method 10 according to the present disclosure for treating/cooling a process fluid 12 with a working fluid 14. At step 16, the working fluid 14 is sprayed into a stream of the process fluid 12 in a suitable structure, such as a—mixing chamber. The sprayed working fluid 14 and process fluid 12 commingle until the desired treating/cooling has been achieved. Thereafter, at step 18, the commingled fluids are directed into one or more separators where the treated/cooled process fluid is separated from the working fluid. At step 20, the separated working fluid is returned to the system to again treat/cool the stream of process fluid 12. In some embodiments, during step 20, the separated working fluid may be conditioned in some manner. Conditioning may include changing a concentration of one or more components of the working fluid, changing a temperature of the working fluid, changing a pressure of the working fluid, adding or removing one components of the working fluid, etc. Generally, the conditioning allows the working fluid to return to a suitable state in order to be recycled and reused in the process. It should be understood that when the method 10 commences, the working fluid 14 may be a "fresh" charge of working fluid that has not been previously sprayed and separated. In some embodiments, the treating/cooling is done with direct contact (i.e., physical contact between the process fluid and the working fluid) between the process fluid and the working fluid.

Figure 2:
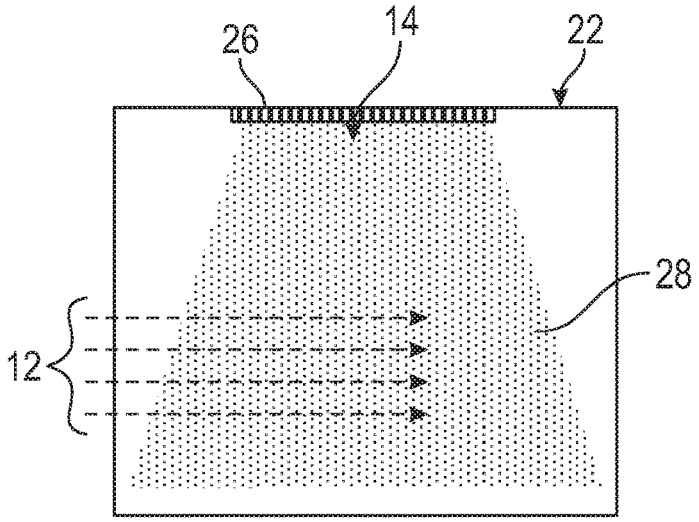
FIG. 2 schematically illustrates a process fluid being sprayed by a working fluid according to one embodiment of the present disclosure.

Referring to FIG. 2, the treating/cooling step may be performed in a suitable structure 22 in which one or more streams of the working fluid 14 are applied to one or more streams of the process fluid 12. The structure 22 may be a fully enclosed or partially enclosed tank, chamber, pipe, or other enclosure that promotes the mixing of the fluids 12, 14. While the stream of working fluid 14 is shown transverse to the stream of process fluid 12, the contact between the fluids 12, 14 may also occur using parallel, concurrent flows or parallel counter-current flows.

In embodiments, the working fluid 14 may be a liquid that is atomized before being contacted with the process fluid 12 by using a suitable atomizer 26. In one non-limiting embodiment, the atomizer 26 may include one or more nozzles that converts the bulk working fluid 14 into a dispersion of small droplets 28. In other embodiments, an atomizer 26 can use a working fluid pressure energy (e.g., pressure atomization via a small orifice), kinetic energy (e.g. swirl atomization), vibrational energy (e.g., ultrasonic atomization) or combination of the above mentioned atomization methods. In embodiments, the droplets 28 may have a Sauter Mean Droplet size of no greater than 500 micrometers, or no greater than 300 micrometers, or no greater than 100 micrometers.

Figure 3:
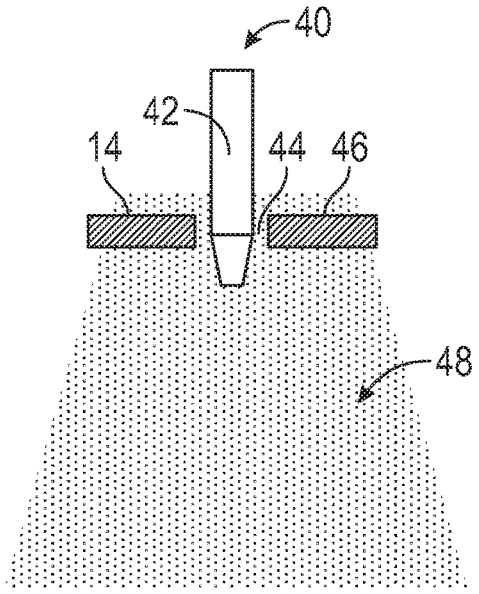
FIG. 3 schematically illustrates a nozzle spraying a working fluid according to one embodiment of the present disclosure.

Referring to FIG. 3, there is shown one non-limiting embodiment of a nozzle 40 that may be used to atomize the working fluid 14. The nozzle 40 may be one of a plurality of nozzles that may be arrayed in any number of arrangements; e.g., rows-columns, spiral, circular, etc. The nozzles 40 may include a working fluid conduit 42 disposed in an orifice 44 in a body 46. A treatment/cooling zone 48 may be defined adjacent to an outlet of the orifice 44. One skilled in the art will appreciate that the configuration of the nozzle 40 will depend upon factors such as the fluid properties of the working fluid and the process fluid, the pressure of the working fluid, the temperatures of the working fluid, etc. It is also emphasizes that the teachings of the present disclosure may be used without the design of the FIG. 3 nozzle 40.

Figure 4:
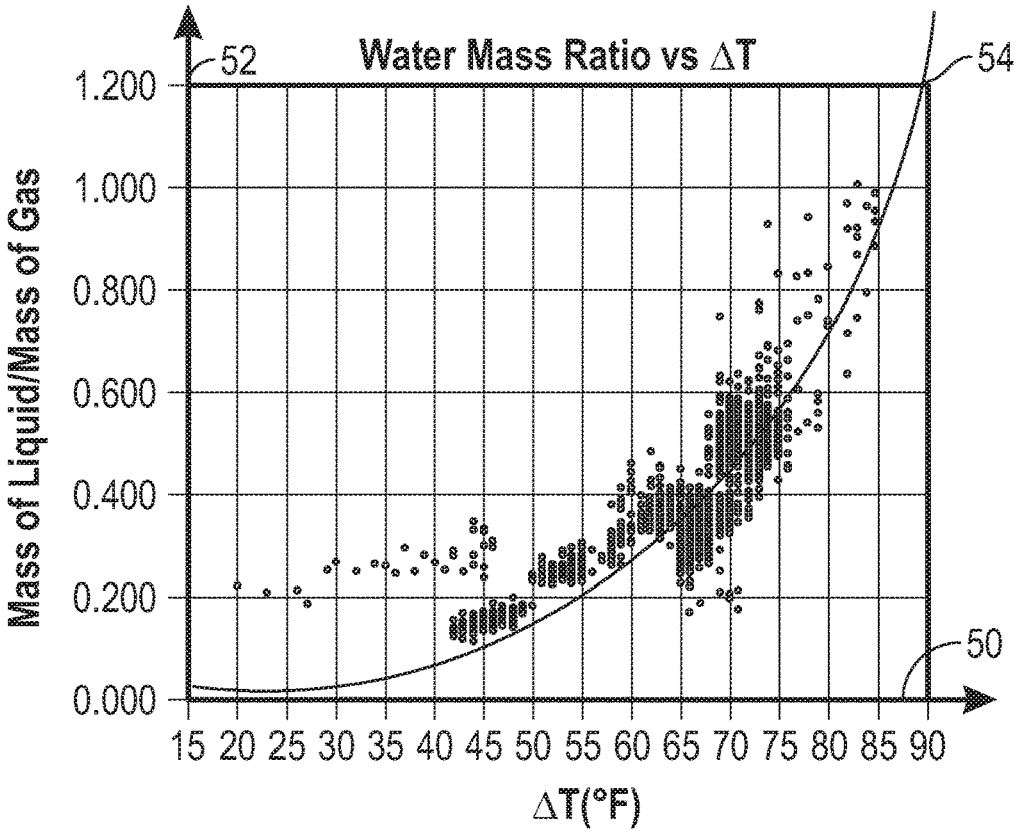
FIG. 4 is a graph illustrating an exemplary relationship between the ratio of mass of working fluid/mass of process fluid and a reduction in temperature of the process fluid.

The treatment/cooling may also be controlled by maintaining a specified mass ratio between the working fluid and the process fluid. In one non-limiting arrangement, the ratio may be defined using a mass flow rates. FIG. 4 illustrates how mass ratio influences the cooling of a process gas for example air when contacted by a working liquid such as water. A temperature differential or amount of cooling obtained in the process fluid as measure in degrees Fahrenheit is along the "x-axis" 50 and the mass of liquid/mass of gas ratio is along the "y-axis" 52. As depicted by curve 54, the relative mass of the working fluid increases, the temperature differential obtained in the process gas increases. In this example, the mass ratio varies from 0.01 to 1.0 over a temperature differential of 20° F. to 90° F. To obtain a 90° F. temperature differential, it is estimated that a volume of the working liquid, e.g., water volume will be approximately 1% of the volume of the process gas (air) at standard conditions (both fluids at a temperature of 70 F and pressure of 14.7 psia). One of the method to control cooling performance is using smallest possible working liquid droplet size distribution. The atomization nozzles used in above experiments produced droplet size distribution in terms of Sauter Mean Diameter (SMD) of approximately 100 micron meters. Higher droplet size distribution will result in higher mass of liquid/mass of gas ratio.

Figure 5:
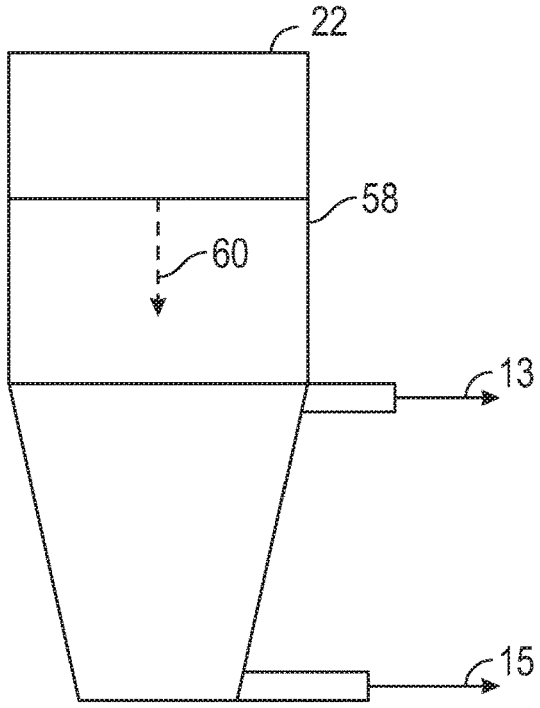
FIG. 5 schematically illustrates a separator spraying a working fluid according to one embodiment of the present disclosure.

Referring to FIG. 5, there is shown one non-limiting embodiment of a separator 58 that may used to separate two or more fluids used in the present methods. The separator may be used to separate a process fluid from a working fluid or, as described later, a primary working fluid from a secondary working fluid. The separator 58 may be any known gas-liquid separators, include single stage or multistage cyclone or hydro-cyclone separators. Generally, the separator 58 receives a mixture 60 of process fluid and working fluid from the mixer 22 and ejects a first stream of treated/cooled process fluid 13 and a second stream of separated working fluid 15. The separation, which may occur in a single stage or multiple stages, may result in a separation of efficiency of 80% or greater, 90% or greater, 95% or greater, or 99% or greater. The separated working fluid 15 may now be advantageously re-used, or recycled, for further treatment/cooling at which point is the same as the working fluid 14 as shown in FIG. 1.

Figure 6:
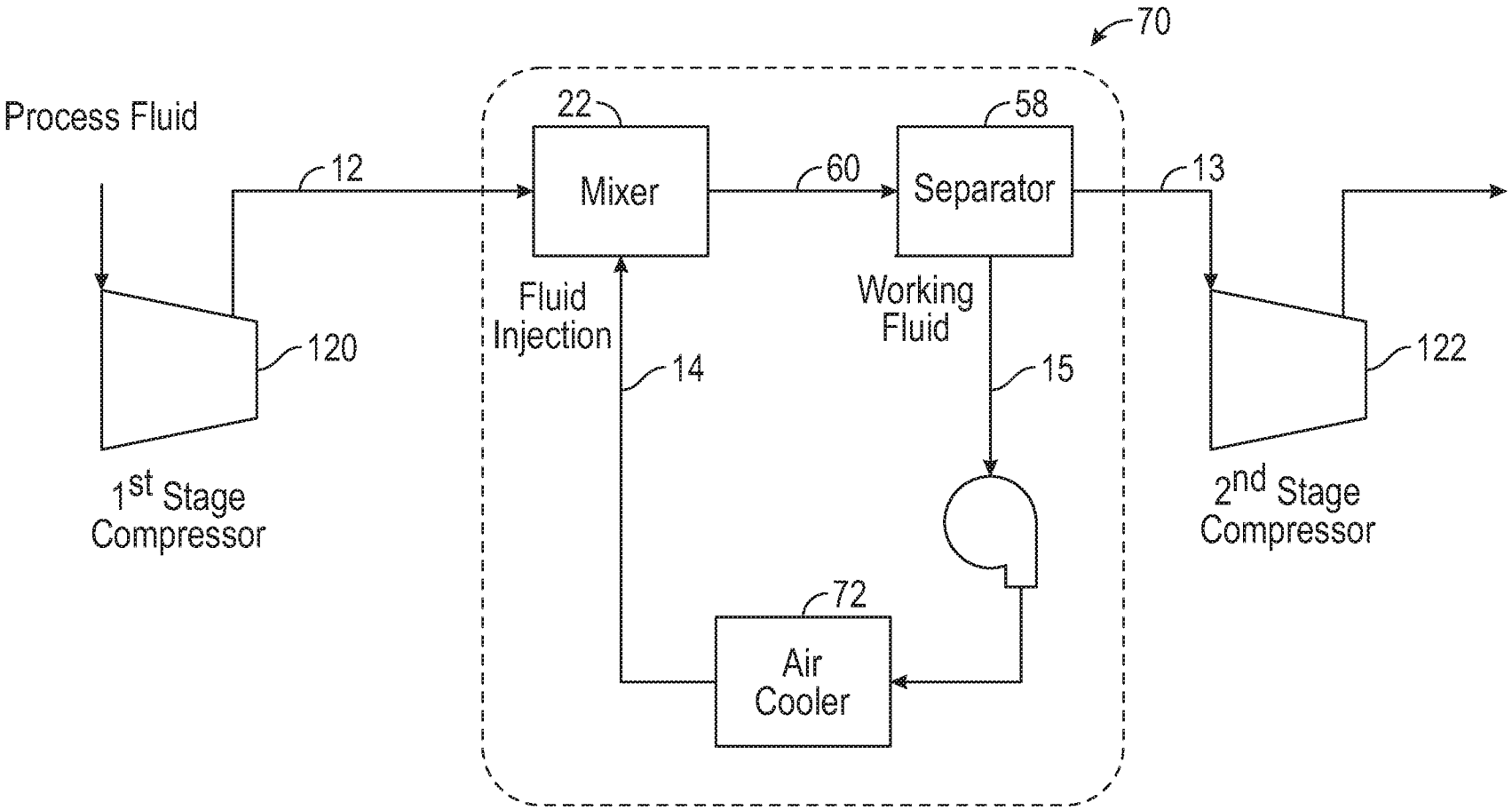
FIG. 6 schematically illustrates a system wherein a process fluid is cooled using a recycled working fluid according to one embodiment of the present disclosure.
Figure 7:
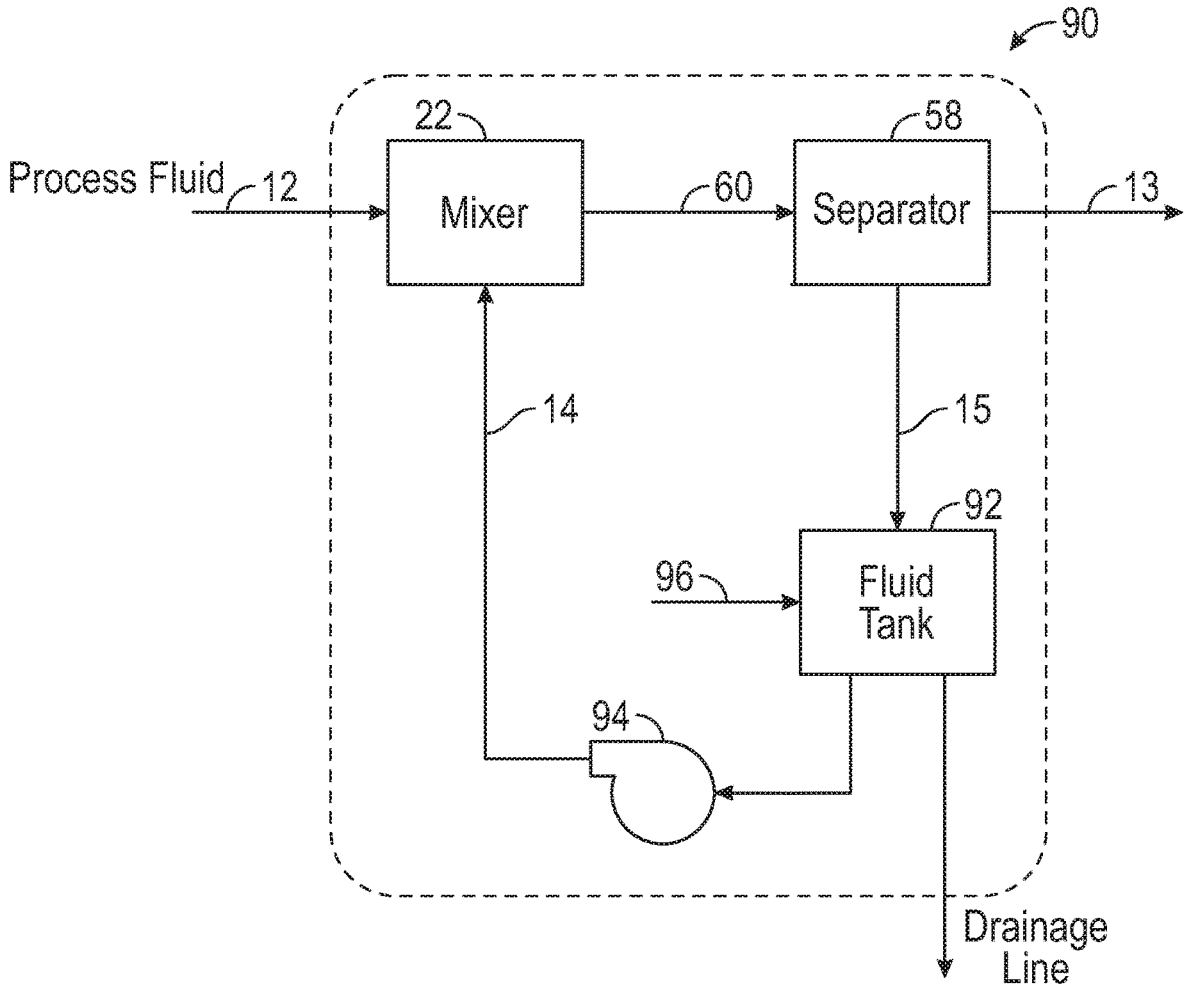
FIG. 7 schematically illustrates a system wherein a process fluid is treated and optionally cooled using a recycled working fluid according to one embodiment of the present disclosure.
Figure 8:
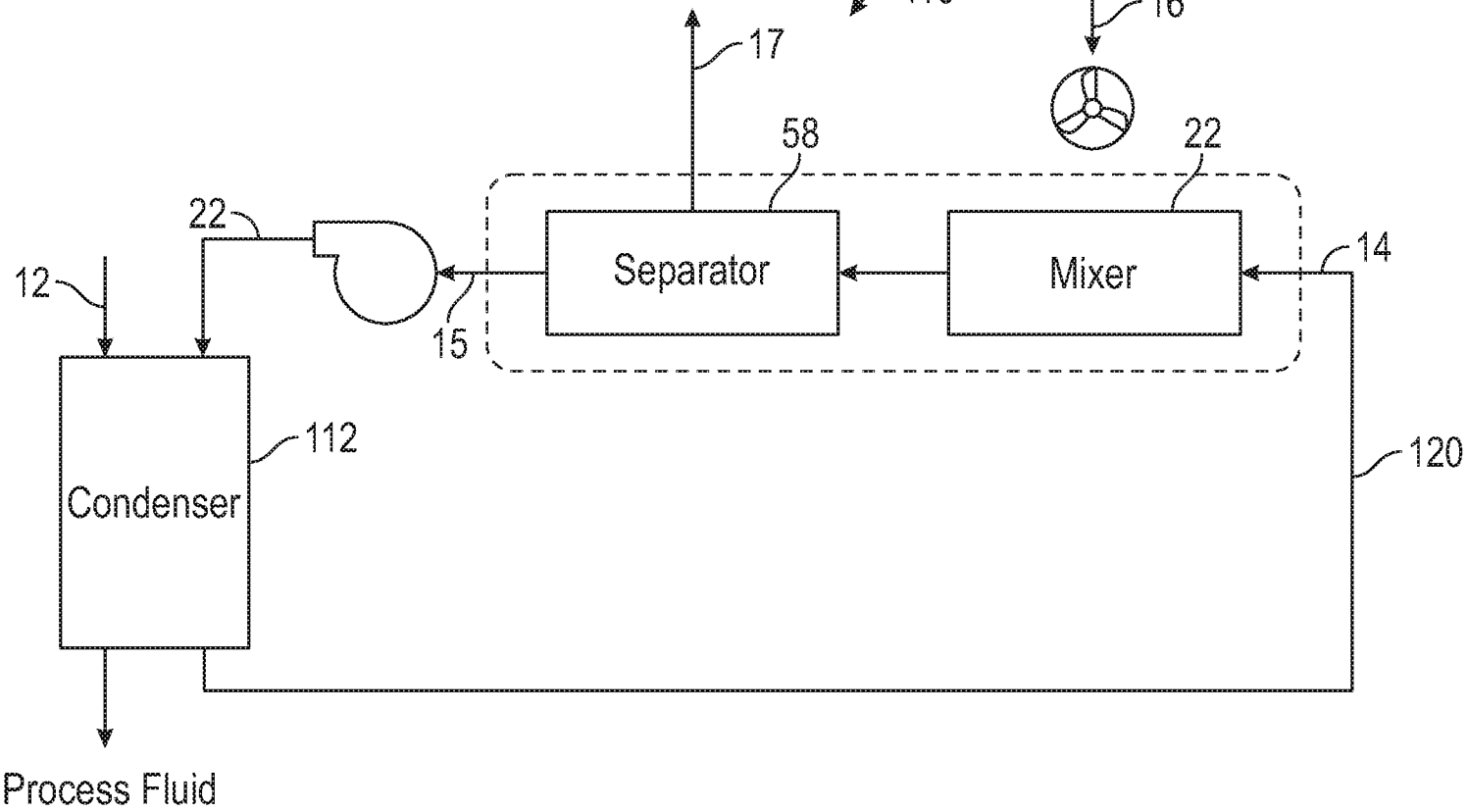
FIG. 8 schematically illustrates a system wherein a process fluid is cooled using a recycled working fluid that is cooled according to one embodiment of the present disclosure.

The teachings of the present disclosure may be implemented numerous situations. FIGS. 6-8 illustrate three non-limiting applications for the present teachings.

Referring to FIG. 6, there is shown a system 70 for cooling a process fluid 12, which may be a gas, using a working fluid 14, which may be a liquid. The process fluid 12 may be a produced hydrocarbon gas from a well, a gas effluent from a combustion process, or other gas effluent that requires cooling. The working fluid 14 may be a refrigerant, water, glycol, mixtures of water and glycol, or other suitable liquid. The system 70 includes a mixer 22 in which the working fluid 14 is sprayed into the process fluid 12. As noted previously, the working fluid 14 may be atomized to have a desired droplet size (e.g., SMD of 100 micro meters or less). While in the mixed state, the atomized working fluid 14 absorbs a portion of the thermal energy resident in the process fluid 12. The mixture 60 of the process fluid 12 and the working fluid 14 are then sent to a separator 58 that outputs a cooled process fluid 13 and a separated working fluid 15. The separated working fluid 15 may be directly returned to the mixer 22. Alternatively, as shown, the separated working fluid 15 is conditioned by being pumped or otherwise conveyed to a cooler 72 that thermally unloads a portion of the absorbed heat before the separated working fluid 15 is sent to the mixer 22.

Referring to FIG. 7, there is shown a system 90 for treating, and optionally cooling, a process fluid 12 using a working fluid 14. As discussed previously, the process fluid 12 may be a produced hydrocarbon gas from a well or any other gas effluent that requires treating and possibly cooling. The working fluid 14, or a component of the fluid, may chemically interact with the process fluid 12, or one or more components of the process fluid. As a non-limiting example, the working fluid 14 may be partly or wholly composed of regenerative chemical scavengers used to reduce $H_2S$ from hydrocarbon gases (such as Triazine, methanol, amines, etc.). The system 90 includes a mixer 22 in which the working fluid 14 is sprayed into the process fluid 12. As noted previously, the working fluid 14 may be atomized to have a desired droplet size (e.g., SMD of 100 micro meters or less). While in the mixed state, the atomized working fluid 14 chemically interacts with the process fluid 12 and, optionally, absorbs a portion of the thermal energy resident in the process fluid 12. The mixture 60 of process fluid 12 and working fluid 14 are then sent to a separator 58 that outputs a treated/cooled process fluid 13 and a separated working fluid 15.

The outputted process gas 13 may have been chemically transformed in on ore more aspects, such as a reduction in the content of one or more components for example $H_2S$ from sour wellhead gas, a change in a chemical property (e.g., pH), or other chemical property. The separated working fluid 15 may be directly returned to the mixer 22 or, as shown, pumped or otherwise conveyed to a container 92 and stored until needed. A suitable fluid mover 94, such as a pump, may be used to convey the working fluid 94 from the container 92 to the mixer 22. The separated working fluid 15 may be conditioned prior to reuse. For example, while not shown, the separated working fluid 15 may be thermally unloaded before being sent to the mixer 22. Also, fresh working fluid may be added via a line 96 to the container 92 to adjust the chemical composition or other property to restore the efficacy of the working fluid 14 as, for example, a scavenger that can be refreshed by draining out the spent scavenger (of higher density than fresh liquid) from bottom of fluid container 92.

Referring to FIG. 8, there is shown a system 110 for cooling, a process fluid 12 using primary working fluid 14 and a secondary working fluid 16. In this non-limiting embodiment, the process fluid 12 may be a gas such as steam generated while producing electrical power. In other embodiments, the process fluid 12 may be a liquid or liquid and gas mixture. The working fluids 14, 16 cooperate to cool the process fluid 12. As a non-limiting example, the primary working fluid 14 may be a liquid, such as water, and the secondary working fluid 16 may be a gas, such as air. In this embodiment, the primary working fluid 14 is recycled and the secondary working fluid 16 is a cooling fluid that is not recycled.

The system 110 may be configured as a closed loop 120 having a serially arranged mixer 22, a separator 58, and a heat exchanger or condenser 112. The primary working fluid 14 is sprayed into the secondary working fluid 16 in the mixer 22 As noted previously, the primary working liquid 14 may be atomized to have a desired droplet size (e.g., SMD of 100 micro meters or less). The atomized primary working fluid 14 transfers a portion of resident thermal energy to the secondary working fluid 16. The mixture of primary, and secondary working fluids 14, 16 is then sent to a separator 58 that outputs a cooled primary working fluid 15 and a separated secondary working fluid 17.

The heat exchanger 112 is configured to indirectly cool the process fluid 12 with the cooled primary working fluid 15. The heat exchanger 112 may be a shell and tube heat exchanger or any other structure that allows the transfer of thermal energy between two or more bodies of fluids without direct physical contact between those fluid streams. While in the heat exchanger, the process fluid 12 indirectly transfers thermal energy to the primary working fluid 15. Upon exiting the heat exchanger 112, the heated primary working fluid 14 is returned by the loop 120 to the mixer 22.

It should be noted that the system 110 may also be viewed as a system wherein the primary working fluid 14 is the recycled working fluid and the secondary working liquid 16 is the process fluid. It should be noted that the recycled working fluid 14 is not conditioned. The pumping of the recycled working fluid 14 is for circulation and not to return the working fluid 14 to a state necessary prior to reuse.

Referring to FIG. 6, in an example, a first compressor stage 120 receives natural gas as the process fluid 12. The natural gas has a gas flow rate of 2 mmscfd (83, 136 lbs/d) at 80° F. and 40 psig. The gas exits the first stage compressor 120 at 298° F. and 246 psig. In the mixer 22, the gas is mixed with water droplets, which acts as the working fluid. The water enters the mixer 22 at a temperature of 80° F. The water droplets have a Sauter Mean droplet Diameter (SMD) no greater than 100 micro meters. The water flow rate is 14 gal/min (168, 235 lbs/d). The process gas is separated from the water in the separator 58. The separated process gas 13 has been cooled to 298° F. and 246 psig. The separated process gas 13 may then be fed into a second compressor stage 122. The mass ratio for this example is 2.0 (168,235 lbs/83,136 lbs). The process gas has a $\Delta T$=(298° F.−152° F.)=146° F. Referring to the graph of FIG. 4, at mass ratio of 1.0, $\Delta T$ of approximately 85° F. For a mass ratio of 2.0, extrapolation results in a $\Delta T$ of approximately 150° F.

A similar range of mass ratio (mass of working fluid/mass of process fluid) and temperature differential ($\Delta T$) values were observed using air, which is a relatively denser fluid, as shown in the graph of FIG. 4. On sensible heat transfer point of view, methane has on average approximately 20% higher specific heat (Cp) compared to air (Cp methane=0.0239 Btu/ft3° F.; Cp air=0.0193 Btu/ft3° F. at 100° F.). Thus, methane gas as a process fluid would require on average approximately 20% higher mass ratio for cooling at similar temperature differentials ($\Delta T$) than air.

Referring to FIG. 7, in an example, a "sour" gas is the process fluid 12. The "sour" gas has an $H_2S$ concentration of 100 ppm. In the mixer 22, the "sour" gas is mixed with droplets of Triazine, a scavenger. The scavenger droplets have a Sauter Mean droplet Diameter (SMD) no greater than 100 micron meters. The Triazine flow rate is 48 gal/day. The "sour" gas is separated from the Triazine in the separator 58. The separated "sour" gas 13 has an $H_2S$ concentration lowered to 20 ppm. During recycling, "spent" or otherwise lost Triazine is made up with a fresh Triazine stream 96 at a flow rate of 16 gal/day. Typical scavenger sulfur removal efficiency or consumption is about 0.1 gal scavenger per mmscf gas per $H_2S$ (ppm) removed. The resulting amount of lost Triazine is 0.1 gal×2 mmscfd*(100−20) ppm, or 16 gal/day.

As used in the present specification:

A "fluid" may include one or more of: a gas, a liquid, a plasma, and mixtures thereof. A fluid may also include entrained solids.

The words "comprising" and "comprises" as used throughout the claims, are to be interpreted to mean "including but not limited to" and "includes but not limited to", respectively.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

What is claimed is:

1. A method of treating/cooling a process fluid, comprising:

spraying a working fluid into a stream of the process fluid to form a mixed fluid;

separating the working fluid from the mixed fluid using a gas-liquid separator to form a separated process fluid and a separated liquid working fluid;

conditioning the separated working fluid to form a recycled working fluid; and spraying the cooled recycled working fluid into the stream of the process fluid to form a further mixed fluid.

2. The method of claim 1, wherein:

the process fluid is primarily a gas;

the working fluid is primarily a liquid; and the conditioning includes compressing the separated working fluid.

3. The method of claim 2, wherein the conditioning further includes adding additional working fluid.

4. The method of claim 1, wherein the spray of the working fluid includes Sauter Mean droplet Diameter (SMD) no greater than 100 micro meter.

5. The method of claim 1, wherein the process fluid is a hydrocarbon produced from a well.

6. The method of claim 1, wherein the spraying reduces an amount of a selected chemical component of the process fluid a predetermined amount due to chemical interaction between the working fluid and the process fluid.

7. A method of treating a process fluid, comprising:

spraying a working fluid into a cooling fluid to form a mixed fluid;

separating the working fluid from the mixed fluid using a gas-liquid separator to form a cooled working fluid and a separated cooling fluid;

indirectly cooling a process fluid using the cooled working fluid; and recycling the cooled working fluid after the indirect cooling by spraying the cooled working fluid into the cooling fluid.

8. The method of claim 7, wherein the working fluid is primarily a liquid;

the cooling fluid is primarily a gas; and the process fluid is primarily a gas.

9. A method of treating/cooling a process fluid, comprising:

spraying at least one working fluid in the form of microdroplets with Sauter Mean Diameter no greater than 100 micronmeter onto a selected fluid;

separating the at least one working fluid from the selected fluid using gas-liquid centrifugal separation; and contacting the process fluid with the microdroplets of at least one working fluid.

10. The method of claim 9, wherein the process fluid is the selected fluid, and wherein the contacting occurs during the spraying, and wherein the contacting is a direct contact between the process fluid and the at least one working fluid.

11. The method of claim 9, wherein the at least one working fluid includes a primary working fluid and a secondary working fluid, wherein the primary working fluid is sprayed onto the secondary working fluid, and wherein the primary working fluid is indirectly contacted with the process fluid after being separated from the secondary working fluid.

* * * * *